US006412447B1

(12) United States Patent
Trant et al.

(10) Patent No.: US 6,412,447 B1
(45) Date of Patent: Jul. 2, 2002

(54) FUEL-FIRED WATER HEATER WITH FLAMMABLE VAPOR SENSOR AND ASSOCIATED INDUCED FLOW TUBE

(75) Inventors: Troy E. Trant; Gary A. Elder; William T. Harrigill; Bruce A. Hotton; Shannon H. McCall, all of Montgomery, AL (US)

(73) Assignee: The Water Heater Industry Joint Research and Development Consortium, Reston, VA (US)

( * ) Notice: Subject to any disclaimer, the term of this patent is extended or adjusted under 35 U.S.C. 154(b) by 0 days.

(21) Appl. No.: 09/835,753

(22) Filed: Apr. 16, 2001

(51) Int. Cl.[7] ..... F22B 5/04
(52) U.S. Cl. ..... 122/14.21; 122/14.2; 122/14.31
(58) Field of Search ..... 122/13.01, 14.21, 122/14.1, 17.1, 14.2, 14.31; 110/162; 126/361.1, 362.1

(56) References Cited

U.S. PATENT DOCUMENTS

| | | | | |
|---|---|---|---|---|
| 4,271,357 A | | 6/1981 | Bradshaw et al. | 250/287 |
| 4,368,636 A | | 1/1983 | Thorn et al. | 73/40.5 R |
| 4,549,525 A | * | 10/1985 | Narang | 126/361.1 |
| 4,869,232 A | | 9/1989 | Narang | 126/361 |
| 5,020,512 A | | 6/1991 | Vago et al. | 126/350 R |
| 5,146,911 A | | 9/1992 | Adams | 126/350 R |
| 5,533,495 A | | 7/1996 | Moore, Jr. | 126/350 R |
| 5,697,330 A | * | 12/1997 | Yetman et al. | 122/13.1 |
| 5,765,547 A | * | 6/1998 | La Plante | 122/13.1 |
| 5,797,355 A | | 8/1998 | Bourke et al. | 122/13.1 |
| 6,003,477 A | | 12/1999 | Valcic | 122/13.1 |
| 6,138,613 A | | 10/2000 | Bourke et al. | 122/13.1 |

* cited by examiner

*Primary Examiner*—Gregory Wilson
(74) *Attorney, Agent, or Firm*—Konneker & Smith, P.C.

(57) ABSTRACT

Fuel fired power vented and natural draft type water heaters are provided with flammable vapor sensors operative to detect flammable vapors exteriorly adjacent the water heater and responsively preclude fuel flow to the burner portion of the water heater. In each water heater a flow tube is extended between the flammable vapor sensor and the draft structure of the water heater and forms a flow path isolated from the combustion chamber of the water heater. In the event that flammable vapors are present exteriorly adjacent the water heater, the forced or natural draft of the water heater creates a biased flow of flammable vapors which is sequentially drawn across the vapor sensor and through the isolated flow path to the draft structure of the water heater.

27 Claims, 5 Drawing Sheets

FUEL-FIRED WATER HEATER WITH FLAMMABLE VAPOR SENSOR AND ASSOCIATED INDUCED FLOW TUBE

BACKGROUND OF THE INVENTION

The present invention generally relates to fuel-fired heating appliances and, in a preferred embodiment thereof, more particularly provides a gas-fired water heater having incorporated therein a specially designed flammable vapor sensor-based burner shut-off system.

Gas-fired residential and commercial water heaters are generally formed to include a vertical cylindrical water storage tank with a gas burner disposed in a combustion chamber below the tank. The burner is supplied with fuel gas through a valved gas supply line, and combustion air through an air inlet flow path providing communication between the exterior of the water heater and the interior of the combustion chamber.

Water heaters of this general type are extremely safe and quite reliable in operation. However, when gasoline or other flammable liquids are stored or used improperly in proximity to the water heater, there may exist a possibility of flammable vapors becoming entrained in the air intake of the water heater. It is theorized that such vapors might cause secondary combustion to occur within the confines of the water heater combustion chamber.

In view of this, various modern gas-fired water heater designs, as well as the designs of other types of fuel-fired heating appliances, focus upon the preclusion of fuel flow to the appliance when extraneous flammable vapors are present exteriorly adjacent the appliance. It is to this design goal that the present invention is directed.

SUMMARY OF THE INVENTION

In carrying out principles of the present invention, in accordance with a preferred embodiment thereof, a fuel-fired heating apparatus is provided with a specially designed system for shutting off fuel flow to the apparatus when flammable vapors are exteriorly adjacent thereto. Representatively, the fuel-fired heating apparatus is a gas-fired water heater. However, principles of this invention are also applicable to other types of fuel-fired heating apparatus such as, for example, boilers and air heating furnaces.

The water heater representatively comprises a tank for holding water to be heated, the tank being disposed within a jacket structure defining a vertically extending insulation cavity circumscribing the tank, and a combustion chamber disposed beneath the tank in thermal communication therewith. A burner structure is disposed within the combustion chamber and is operative to create hot combustion products therein, and a fuel valve is coupled to the burner structure and is operative to supply fuel thereto. A flue communicates with the combustion chamber and extends upwardly through the tank, and a draft structure is coupled to the flue and is operative to create a draft that draws the created hot combustion products upwardly through the flue. In a power vented embodiment of the water heater, the draft structure includes a draft inducer fan, and in a natural draft embodiment of the water heater the draft structure may include an upward extension of the flue.

The fuel supply shut-off system associated with the water heater illustratively comprises a flammable vapor senor and a conduit structure in the form of an induced flow tube. The sensor is positioned and operative to be engaged by and detect flammable vapors exteriorly adjacent the water heater and responsively preclude delivery of fuel from the valve to the burner structure. The conduit structure is communicated with the draft structure, extends to adjacent the sensor, and defines a flow path isolated from the combustion chamber.

The conduit structure is operative to utilize the natural or forced draft of the water heater to forcibly draw adjacent flammable vapors across the sensor and then to the draft structure through the flow path within the conduit structure. Because of this biased flow of flammable vapors through the conduit structure and across the sensor, the contact of the vapors with the sensor is substantially facilitated as compared to simply permitting the vapors to migrate into operative contact with the sensor.

In various illustrative embodiments of the water heater, the conduit or flow tube structure (1) is an integral portion of the water heater jacket structure, (2) is a separate structure which extends externally along the jacket structure, (3) extends upwardly through the combustion chamber and the flue, (4) extends through the tank, or (5) extends through the insulation cavity. Preferably, the water heater further comprises an arrestor plate structure defining a bottom exterior wall portion of the combustion chamber and having a spaced series of flame quenching combustion air inlet openings therein.

DETAILED DESCRIPTION

Figure 1:
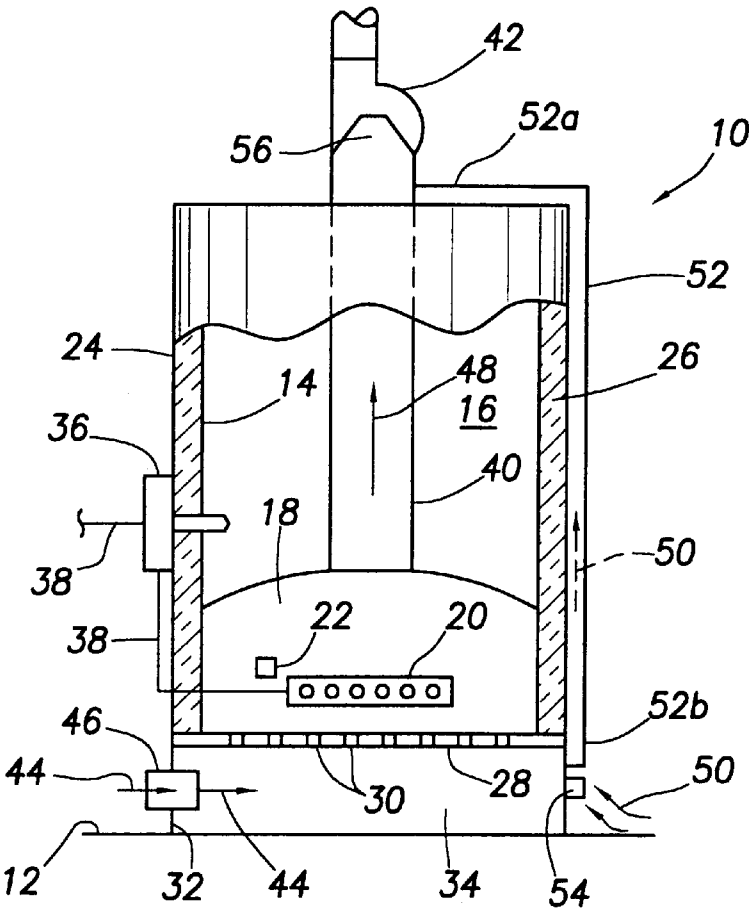

Referring initially to FIG. 1, the present invention provides a fuel-fired heating apparatus which is representatively in the form of a fuel-fired water heater, representatively a gas-fired, power-vented water heater 10, but could alternatively be another type of fuel-fired heating apparatus such as, for example, a boiler or an air heating furnace. Water heater 10 rests upon a floor 12 and has a tank 14 in which a quantity of heated water 16 is stored for on-demand delivery to hot water-utilizing plumbing fixtures such as sinks, showers, bathtubs, dishwashers and the like. A combustion chamber 18 is located beneath the tank 14 and has a fuel burner structure operatively disposed therein, the fuel burner structure including a main gas burner 20 and an associated ignition device, representatively a spark igniter 22. Tank 14 is disposed within a metal jacket 24 that defines an insulation cavity 26 which is filled with a suitable insulation material (not shown) and outwardly circumscribes the tank 14.

A bottom exterior wall portion of the combustion chamber 18 is representatively defined by an arrestor plate structure 28 having a spaced series of flame quenching combustion air inlet openings 30 therein which operate to permit upward flow therethrough of combustion air and flammable vapors, but prevent flames from passing downwardly therethrough.

Arrestor plate openings 30 function similarly to the arrestor plate openings illustrated and described in U.S. Pat. No. 6,035,812 to Harrigill et al which is hereby incorporated herein by reference. A bottom end portion of the water heater 10 is representatively defined by an annular skirt 32 extending downwardly beyond the arrestor plate 28 and forming a plenum area 34 beneath the arrestor plate 28.

Mounted on an exterior side portion of the jacket 24 is a normally closed thermostatic gas valve 36 connected in a gas supply line 38 coupled to the burner 20. A flue 40 is communicated at its lower end with an upper side portion of the combustion chamber 18 and upwardly extends centrally through the tank 14. At its upper end, the flue 40 is connected to a draft structure that includes a draft inducer fan 42 and is operative to create an enhanced upward draft through the flue 40 while the water heater 10 is being operated.

During firing of the water heater 10, and operation of the draft inducer fan 42, combustion air 44 is drawn into the combustion chamber 18 sequentially through a schematically depicted flow path 46 into the plenum 34, and upwardly through the flame quenching arrestor plate openings 30. Combustion air 44 entering the combustion chamber 18 is combusted with fuel gas discharged from the burner 20 to form hot combustion products 48 that are drawn upwardly through the flue 40 by operation of the draft inducer fan 42. Hot combustion products 48 upwardly traversing the flue 40 transfer heat therethrough to the water 16.

According to a key aspect of the present invention, the water heater 10 has incorporated therein a unique fuel shutoff system that operates in response to the presence of flammable vapors 50 exteriorly adjacent the water heater 10 (created, for example, by a flammable liquid spill on the floor 12 adjacent the water heater 10 to preclude fuel supply to the burner 20. As used herein in conjunction with shutting off fuel to the burner 20, the term "preclude" is intended to encompass both (1) shutting off an existing flow of fuel to the burner 20 from the valve 36, and (2) preventing an initiation of fuel flow to the burner 20 from the valve 36.

In the water heater 10 depicted in FIG. 1, the fuel shutoff system includes a conduit structure in the form of an induced flow tube 52, and a flammable vapor sensor 54 representatively supported near floor level adjacent the water heater 10. The tube 52 externally extends along the water heater 10 as indicated in FIG. 1, has a first end 52*a* communicated with an inlet portion 56 of the draft inducer fan 42, and an open second end 52*b* positioned adjacent the flammable vapor sensor 54. As illustrated, the tube 52 defines a flow path that is isolated from the combustion chamber 18. Tube 52 is representatively a separate structure that extends exteriorly along the water heater. Alternatively, tube 52 could be formed as an integral, outwardly projecting portion of the metal jacket 24.

During operation of the water heater 10 an induced draft created within the tube 52 forcibly draws a concentrated flow of flammable vapors 50 (and a quantity of dilution air adjacent the sensor 54) directly across and into contact with the flammable vapor sensor 54, and through the interior of the tube 52 to the inducer fan inlet portion 56. The tube 52 thus creates a forced flow of the flammable vapors 50 across the flammable vapor sensor 54 as opposed to simply permitting the flammable vapors 50 to more slowly migrate into contact with the sensor 54. As will be subsequently described herein, in response to being contacted by the flammable vapors 50, the sensor 54 operates to preclude fuel supply to the burner 20, thereby precluding a flame issuing therefrom and potentially igniting flammable vapors 50 entering the combustion chamber 18.

Figure 2:
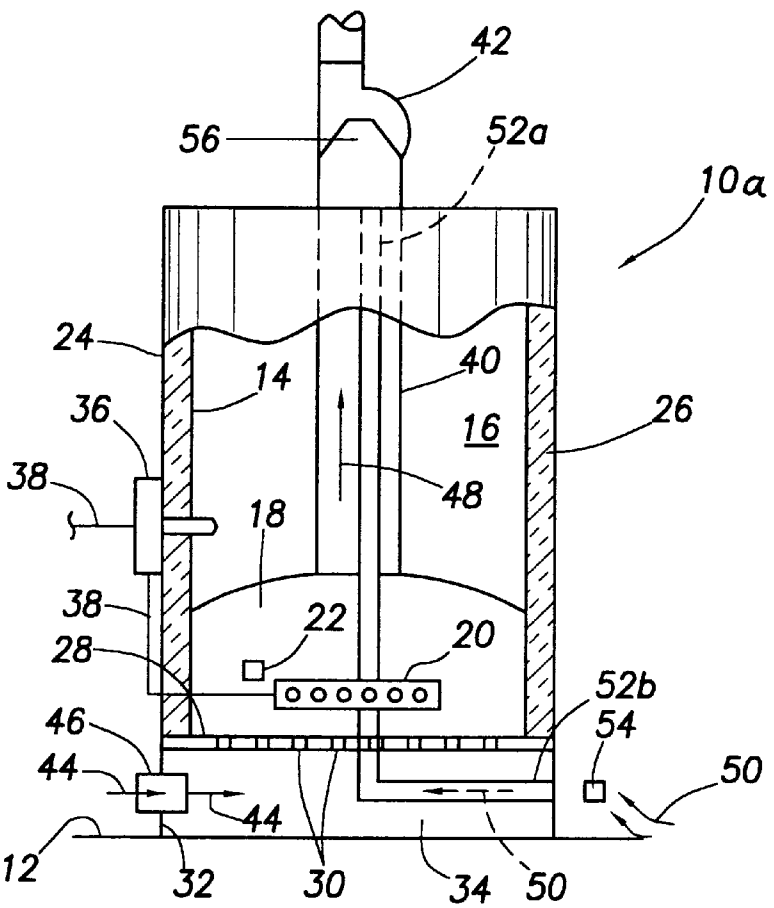
FIGS. 1–4 are schematic depictions of four representative embodiments of a fuel fired, power vented water incorporating therein principles of the present invention.

A first alternate embodiment 10*a* of the water heater 10 of FIG. 1 is illustrated in FIG. 2. Water heater 10*a* is identical in structure and operation to the water heater 10 with the exception that the induced flow tube 52 extends through the plenum 34 and upwardly through the combustion chamber 18 and the flue 40 to the draft inducer fan inlet portion 56.

Figure 3:
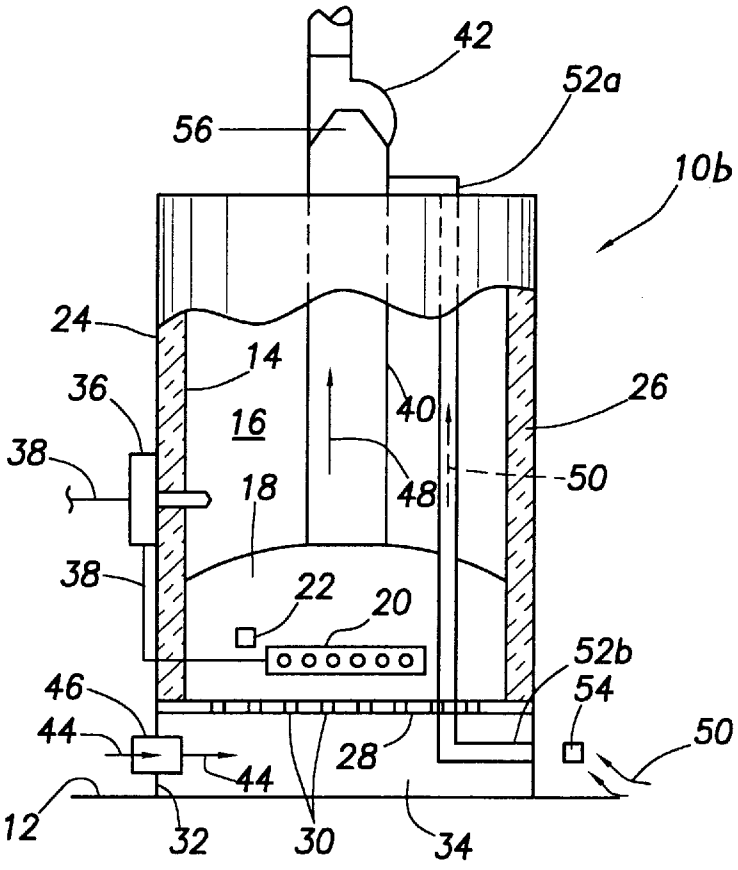

A second alternate embodiment 10*b* of the water heater 10 of FIG. 1 is illustrated in FIG. 3. Water heater 10*b* is identical in structure and operation to the water heater 10 with the exception that the induced flow tube 52 extends through the plenum 34 and upwardly through the tank 14 to the draft inducer fan inlet portion 56.

Figure 4:
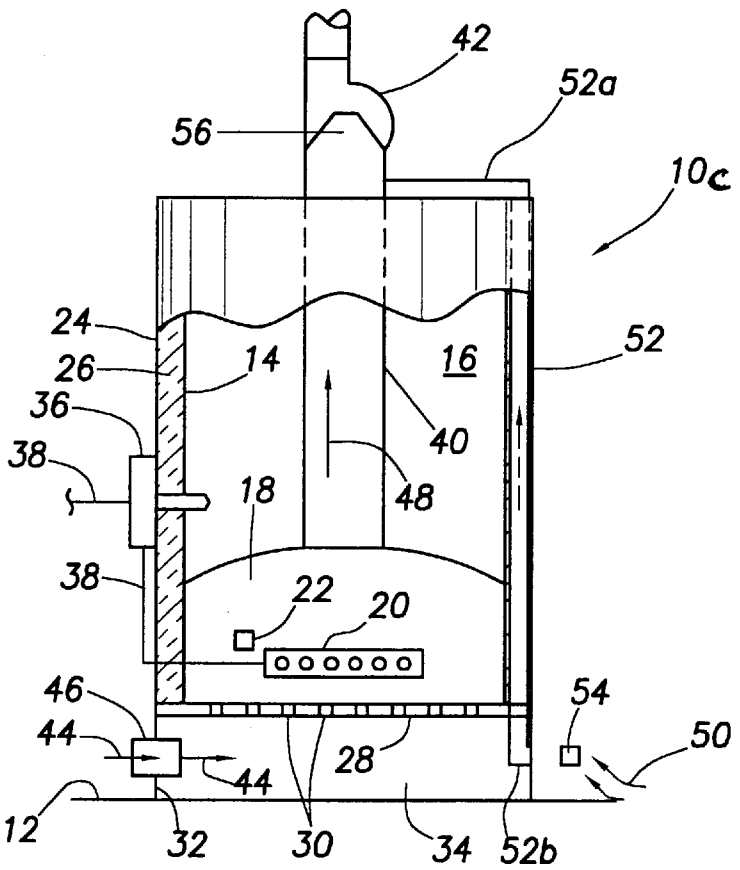

A third alternate embodiment 10*c* of the water heater 10 of FIG. 1 is illustrated in FIG. 4. Water heater 10*c* is identical in structure and operation to the water heater 10 with the exception that the induced flow tube 52 extends through the plenum 34 and upwardly through the annular insulation cavity 26 to the draft inducer fan inlet portion 56. Each of the induced flow tubes 52 in the water heaters 10*a*, 10*b*, 10*c* defines a flow path, through which flammable vapors 52 may be drawn, which is isolated from the combustion chamber 18 of its associated water heater. Thus, flammable vapors traversing such flow path are also isolated from any flame within the combustion chamber 18. Additionally, such flammable vapors traversing this flow path are advantageously isolated from the environment adjacent the water heater, thereby providing a clearing effect for the flammable vapors.

The sensors 54 incorporated in each of the water heaters 10–10*c* function, in response to being contacted by flammable vapors 50, to preclude fuel supply to their associated burners 20. This fuel supply shutoff using the sensors 54 may be accomplished in several manners.

Figure 9:
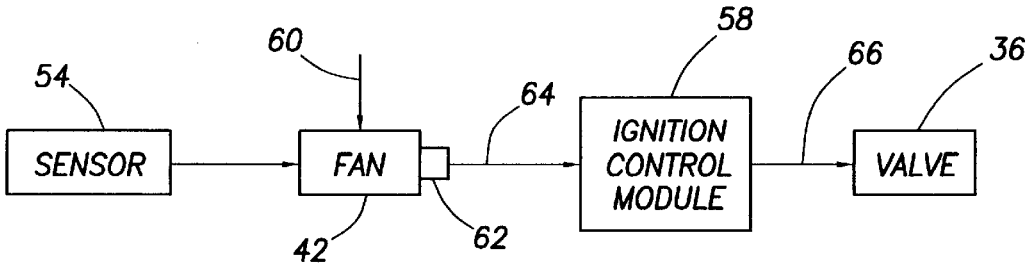
FIGS. 9–11 are schematic diagrams of three representative embodiments of control circuitry incorporating therein a flammable vapor sensor and useable with the power vented water heaters of FIGS. 1–4.

For example, a portion of a representative overall control circuit for each of the power vented water heaters 10–10*c* is schematically depicted in FIG. 9 and includes the flammable vapor sensor 54, the draft inducer fan 42, a conventional ignition control module 58, and the gas supply valve 36. When the addition of heat to the water 16 is required, a thermoset (not shown) transmits a heating demand signal 60 to the draft inducer fan 42. In response to the receipt of the signal 60, the fan 42 is energized and, via a pressure-to-electric switch 62 operatively associated therewith, transmits an output signal 64 to the ignition control module 58. Upon receipt of the signal 64, the ignition control module 58 outputs a signal 66 to the valve 36 to open it and thereby cause fuel to be delivered to the burner 20 via the gas supply line 38. Fuel discharged from the burner 20 is ignited in a conventional manner by operation of the spark ignition 22.

A first illustrative method of precluding fuel supply to the burner 20 when flammable vapors are exteriorly adjacent one of the water heaters 10–10*c* is, as schematically depicted in FIG. 9, to associate the sensor 54 directly with the draft inducer fan 42 in a manner such that when the sensor 54 detects flammable vapors it precludes operation of the fan 42 (either by terminating its operation or by preventing the initiation of its operation), thereby precluding the generation of the signals 64 and 66 and the opening of the valve 36.

Figure 10:
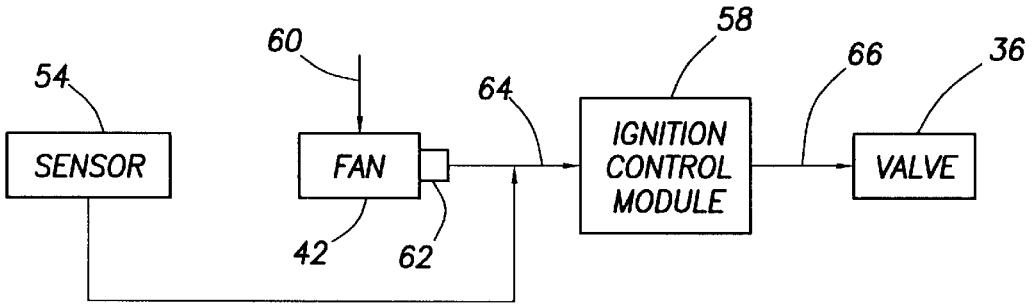

A second illustrative method of precluding fuel supply to the burner 20 when flammable vapors are exteriorly adjacent one of the water heaters 10–10*c* is, as schematically depicted in FIG. 10, to associate the sensor 54 with the illustrated control circuit portion in a manner such that when the sensor 54 detects flammable vapors it precludes the generation of the signal 64 to the ignition control module 58, thereby precluding the generation of the signal 66 and the opening of the valve 36.

Figure 11:
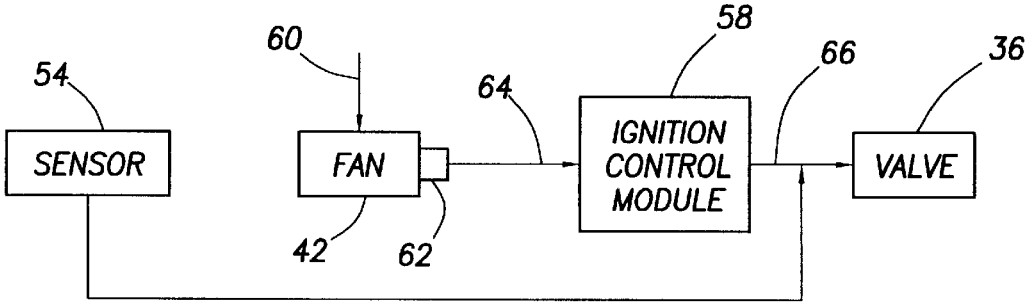

A third illustrative method of precluding fuel supply to the burner 20 when flammable vapors are exteriorly adjacent one of the water heaters 10–10*c* is, as schematically depicted in FIG. 11, to associate the sensor 54 with the illustrated control circuit portion in a manner such that when the sensor 54 detects flammable vapors it precludes the generation of the signal 66 to the valve 36, thereby precluding the opening of the valve 36.

Respectively depicted in schematic form in FIGS. 5–8 are four natural draft fuel-fired embodiments 70–70*c* of the previously described power vented fuel-fired water heaters 10–10*c* shown in FIGS. 1–4. The water heaters 70–70*c,* and their associated fuel shutoff systems, are respectively identical to the previously described water heaters 10–10*c* with the exceptions noted below. Components in the natural draft water heaters 70–70*c* similar to those in the previously described water heaters 10–10*c* have been given identical reference numerals for ease in comparing the water heaters 70–70*c* to the water heaters 10–10*c*.

Figure 5:
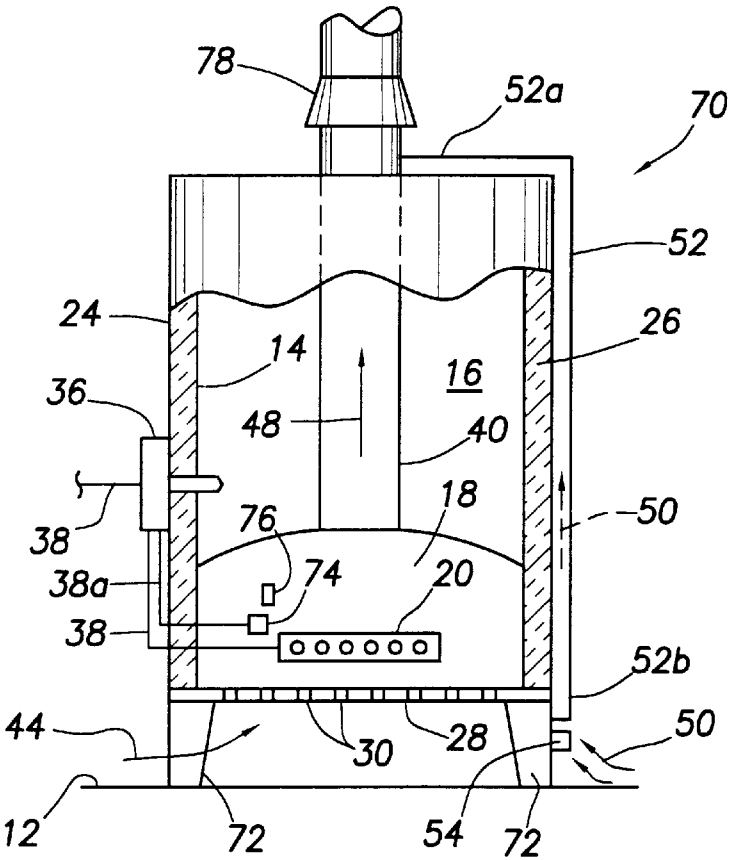

The natural draft water heater 70 shown in FIG. 5 is supported above the floor 12 by depending lower end support legs 72, and the burner structure, in addition to the main fuel burner 20, includes an ignition structure representatively in the form of a standing pilot burner 74 coupled to the fuel valve 36 by a pilot gas supply line 38*a,* and an associated thermocouple structure 76. This ignition portion of the overall burner structure may be replaced by a spark igniter if desired.

In the water heater 70, the previously described draft inducer fan 42 (see FIG. 1) is replaced by conventional natural draft structure 78 operatively communicated with the flue 40. The induced flow tube 52 is run externally along the jacket 24, and may be a separate element or be an integral portion of the jacket 24. The upper end 52*a* of the induced flow tube 52 is communicated with the draft structure 78, and the open lower end 52*a* of the tube 52 is positioned adjacent the flammable vapor sensor 54 to induce (by natural draft) a flow of flammable vapors 50 upwardly through the interior of the flow tube 52 which defines a flow path isolated from the combustion chamber 18.

Figure 6:
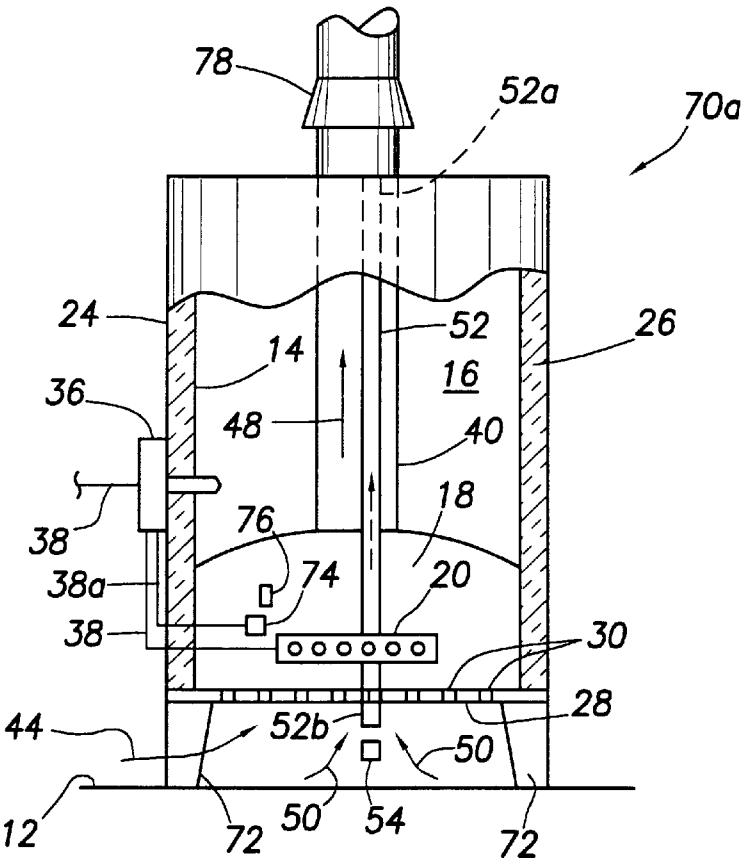
FIGS. 5–8 are schematic depictions of four representative embodiments of a fuel fired, natural draft water heater incorporating therein principles of the present invention.
Figure 8:
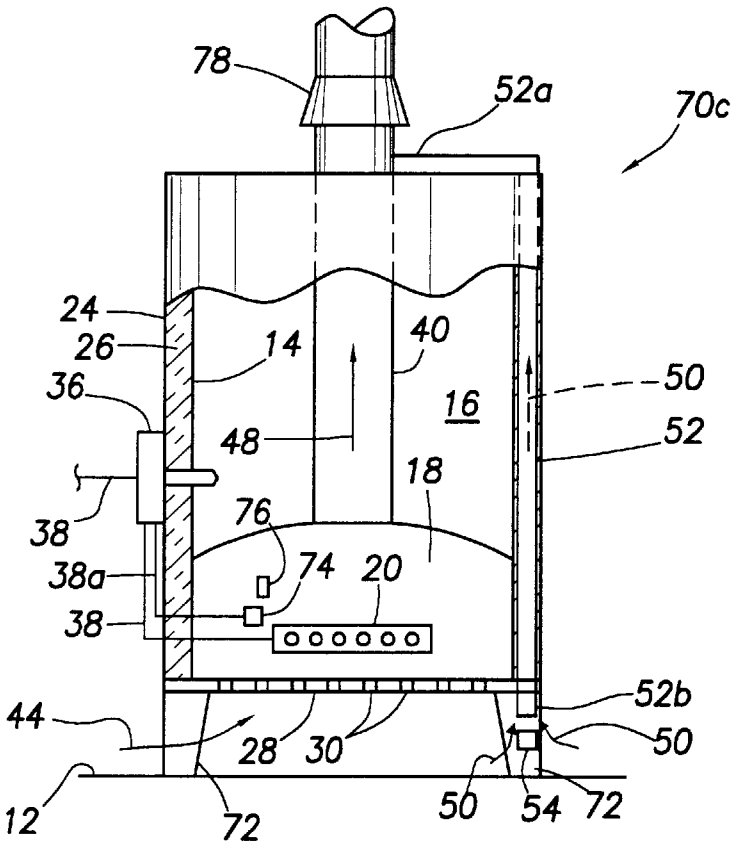
Figure 7:
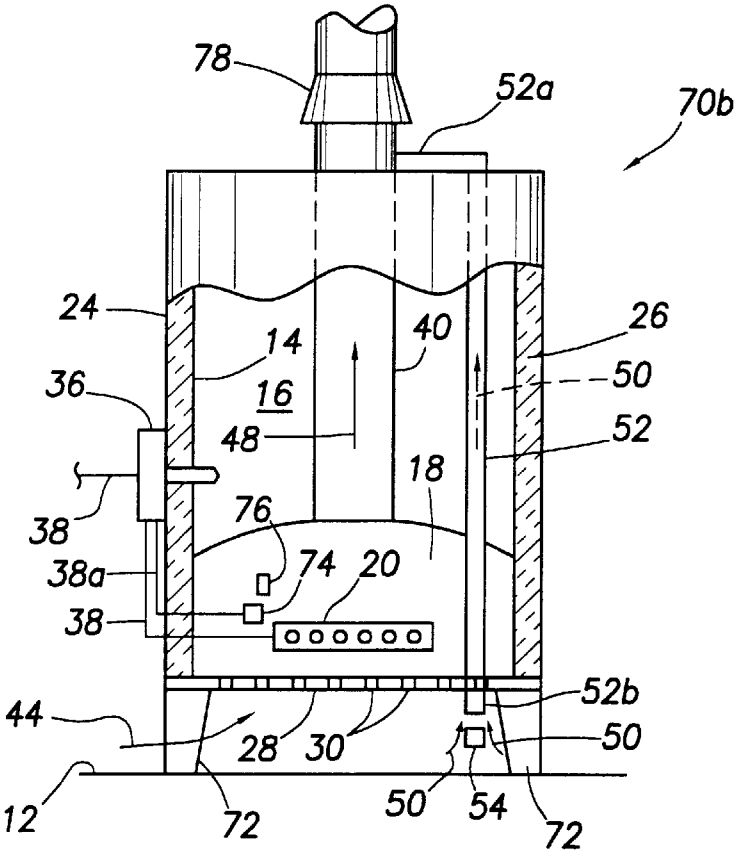

In the natural draft water heater 70*a* shown in FIG. 6 the flow tubes 52 is extended upwardly through the combustion chamber 18 and the flue 40; in the natural draft water heater 70*b* shown in FIG. 7 the flow tube 52 is extended upwardly through the tank 14; and in the natural draft water heater 70*c* shown in FIG. 8, the flow tube 52 is extended upwardly through the insulation cavity 26.

Figure 12:
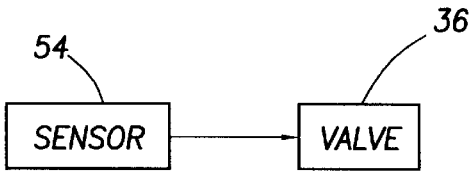
FIGS. 12 and 13 are schematic diagrams of two representative embodiments of control circuitry incorporating therein a flammable vapor sensor and useable with the natural draft water heaters of FIGS. 5–8.

Turning now to FIG. 12, in the flammable vapor sensor-based fuel shutoff systems in the natural draft water heaters 70–70*c,* which utilize standing pilot flames as their burner ignition sources, the sensor 54 may be coupled directly to the valve 36 in an appropriate manner such that when the sensor 54 detects flammable vapors it precludes the valve 36 from opening, thereby precluding gas flow to the main and pilot burners 20 and 74. An example of a flammable vapor sensor coupled to a fuel valve in this manner is shown in FIG. 12 of U.S. Pat. No. 5,797,355 to Bourke et al.

Figure 13:
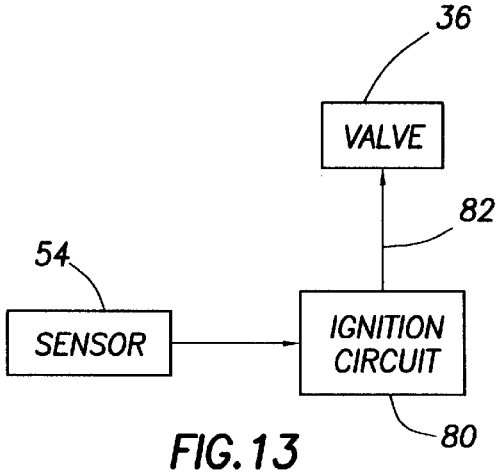

As previously mentioned, the standing pilot flame burner ignition structures in the natural draft water heaters 70–70*c* could be replaced with other ignition structures, such as spark igniters, if desired. To shut off fuel supply to the burner 20 in this instance, the sensor 54 (see FIG. 13) could be connected to the ignition circuit 80 in a manner such that when the sensor 54 detects flammable vapors it respectively acts to preclude the ignition circuit 80 from outputting a valve-opening signal 82, thereby precluding the opening of the valve 36 and a corresponding delivery of fuel to the burner 20.

The foregoing detailed description is to be clearly understood as being given by way of illustration and example only, the spirit and scope of the present invention being limited solely by the appended claims.

What is claimed is:

1. Fuel-fired heating apparatus having a bottom portion and comprising:

a combustion chamber;

a burner structure operative to create hot combustion products within said combustion chamber;

a valve operative to supply fuel to said burner structure;

a flue communicated with said combustion chamber;

a draft structure coupled to said flue and operative to create a draft that draws the created hot combustion products through said flue;

a sensor positioned externally adjacent said bottom portion and operative to be engaged by and detect flammable vapors exteriorly adjacent said fuel-fired heating apparatus and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor, and then to said draft structure through said flow path, without causing the flammable vapors to interiorly traverse said combustion chamber in an exposed relationship therewith.

2. The fuel-fired heating apparatus of claim 1 wherein said fuel-fired heating apparatus is a water heater.

3. The fuel-fired heating apparatus of claim 2 wherein said water heater is a gas-fired water heater.

4. The fuel-fired heating apparatus of claim 1 wherein said fuel-fired heating apparatus is a power vented heating apparatus and said draft structure includes a draft inducer fan.

5. The fuel-fired heating apparatus of claim 1 wherein said fuel-fired heating apparatus has an exterior surface portion and said conduit structure extends outwardly along said exterior surface portion.

6. The fuel-fired heating apparatus of claim 1 further comprising an arrestor plate structure having a spaced series of flame quenching combustion air inlet openings extending therethrough, said arrestor plate structures defining an exterior wall portion of said combustion chamber.

7. Fuel-fired heating apparatus comprising:

a combustion chamber;

a burner structure operative to create hot combustion products within said combustion chamber;

a valve operative to supply fuel to said burner structure;

a flue communicated with said combustion chamber;

a draft structure coupled to said flue and operative to create a draft that draws the created hot combustion products through said flue;

a sensor positioned and operative to be engaged by and detect flammable vapors exteriorly adjacent said fuel-fired heating apparatus and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor and then to said draft structure through said flow path, without causing the flammable vapors to interiorly traverse said combustion chamber in an exposed relationship therewith, said fuel-fired heating apparatus being a natural draft heating apparatus.

8. The fuel-fired heating apparatus of claim 7 wherein:

said valve is a normally closed valve, and said sensor, in response to detection of flammable vapors, is operative to preclude opening of said valve.

9. The fuel-fired heating apparatus of claim 8 wherein:

said fuel-fired heating apparatus further comprises an ignition circuit operative to transmit an output signal to said valve to open it, and said sensor, in response to detection of flammable vapors, is operative to preclude transmission of said output signal to said valve.

10. Fuel-fired heating apparatus comprising:

a combustion chamber;

a burner structure operative to create hot combustion products within said combustion chamber;

a valve operative to supply fuel to said burner structure;

a flue communicated with said combustion chamber;

a draft structure coupled to said flue and operative to create a draft that draws the created hot combustion products through said flue;

a sensor positioned and operative to be engaged by and detect flammable vapors exteriorly adjacent said fuel-fired heating apparatus and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor and then to said draft structure through said flow path, without causing the flammable vapors to interiorly traverse said combustion chamber in an exposed relationship therewith, said fuel-fired heating apparatus having an outer wall portion configured to define said conduit structure.

11. Fuel-fired heating apparatus comprising:

a combustion chamber;

a burner structure operative to create hot combustion products within said combustion chamber;

a valve operative to supply fuel to said burner structure;

a flue communicated with said combustion chamber;

a draft structure coupled to said flue and operative to create a draft that draws the created hot combustion products through said flue;

a sensor positioned and operative to be engaged by and detect flammable vapors exteriorly adjacent said fuel-fired heating apparatus and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor and then to said draft structure through said flow path, without causing the flammable vapors to interiorly traverse said combustion chamber in an exposed relationship therewith, said conduit structure extending through said combustion chamber and said flue.

12. Fuel-fired heating apparatus comprising:

a combustion chamber;

a burner structure operative to create hot combustion products within said combustion chamber;

a valve operative to supply fuel to said burner structure;

a flue communicated with said combustion chamber;

a draft structure coupled to said flue and operative to create a draft that draws the created hot combustion products through said flue;

a sensor positioned and operative to be engaged by and detect flammable vapors exteriorly adjacent said fuel-fired heating apparatus and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor and then to said draft structure through said flow path, without causing the flammable vapors to interiorly traverse said combustion chamber in an exposed relationship therewith, said fuel-fired heating apparatus having an interior portion in thermal communication with said combustion chamber and adapted to receive a fluid to be heated, and wherein said conduit structure extends through said interior portion.

13. Fuel-fired heating apparatus comprising:

a combustion chamber;

a burner structure operative to create hot combustion products within said combustion chamber;

a valve operative to supply fuel to said burner structure;

a flue communicated with said combustion chamber;

a draft structure coupled to said flue and operative to create a draft that draws the created hot combustion products through said flue;

a sensor positioned and operative to be engaged by and detect flammable vapors exteriorly adjacent said fuel-fired heating apparatus and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor and then to said draft structure through said flow path, without causing the flammable vapors to interiorly traverse said combustion chamber in an exposed relationship therewith, said fuel-fired heating apparatus having an insulation cavity defined between exterior and interior wall portions of said fuel-fired heating apparatus, and wherein said conduit structure extends through said insulation cavity.

14. Fuel-fired heating apparatus comprising:

a combustion chamber;

a burner structure operative to create hot combustion products within said combustion chamber;

a valve operative to supply fuel to said burner structure;

a flue communicated with said combustion chamber;

a draft structure coupled to said flue and operative to create a draft that draws the created hot combustion products through said flue;

a sensor positioned and operative to be engaged by and detect flammable vapors exteriorly adjacent said fuel-fired heating apparatus and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor and then to said draft structure through said flow path, without causing the flammable vapors to interiorly traverse said combustion chamber in an exposed relationship therewith;

said fuel-fired heating apparatus being a power vented heating apparatus and said draft structure including a draft inducer fan;

said valve being a normally closed valve, said fan, when energized, being operative to generate a first output signal; and said fuel-fired heating apparatus further comprising an ignition module control operative to receive said first output signal and responsively transmit to said valve a second output signal which causes said valve to open.

15. The fuel-fired heating apparatus of claim 14 wherein said sensor, in response to detection of flammable vapors, is operative to preclude operation of said fan.

16. The fuel-fired heating apparatus of claim 14 wherein said sensor, in response to detection of flammable vapors, is operative to preclude the generation of said first output signal.

17. The fuel-fired heating apparatus of claim 14 wherein said sensor, in response to detection of flammable vapors, is operative to preclude the transmission of said second output signal to said valve.

18. Fuel-fired water heater having a bottom portion and comprising:

a tank for holding water to be heated, said tank being disposed within a jacket structure defining a vertically extending insulation cavity circumscribing said tank;

a combustion chamber disposed beneath said tank in thermal communication therewith;

a burner structure disposed within said combustion chamber and operative to create hot combustion products therein;

a fuel valve coupled to said burner structure and operative to supply fuel thereto;

a flue communicating with said combustion chamber and extending upwardly through said tank;

a draft structure coupled to said flue and operative to create a draft that draws the created hot combustion products upwardly through said flue;

a sensor positioned externally adjacent said bottom portion and operative to be engaged by and detect flammable vapors exteriorly adjacent said water heater and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor, and then to said draft structure through said flow path, without causing the flammable vapors to interiorly traverse said combustion chamber in an exposed relationship therewith.

19. The fuel-fired water of claim 18 wherein said water heater is a gas-fired water heater.

20. The fuel-fired water heater of claim 18 wherein said water heater is a power vented water heater and said draft structure includes a draft inducer fan.

21. The fuel-fired water heater of claim 18 wherein said conduit structure extends externally along said jacket structure.

22. The fuel-fired water heater of claim 18 further comprising an arrestor plate structure defining a bottom exterior wall portion of said combustion chamber and having a spaced series of flame quenching combustion air inlet openings therein.

23. A fuel-fired water heater comprising:

a tank for holding water to be heated, said tank being disposed within a jacket structure defining a vertically extending insulation cavity circumscribing said tank;

a combustion chamber disposed beneath said tank in thermal communication therewith;

a burner structure disposed within said combustion chamber and operative to create hot combustion products therein;

a fuel valve coupled to said burner structure and operative to supply fuel thereto;

a flue communicating with said combustion chamber and extending upwardly through said tank;

a draft structure coupled to said flue and operative to create a draft that draws the created hot combustion products upwardly through said flue;

a sensor positioned and operative to be engaged by and detect flammable vapors exteriorly adjacent said water heater and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor, and then to said draft structure through said flow path, without causing the flammable vapors to interiorly traverse said combustion chamber in an exposed relationship therewith, said water heater being a natural draft water heater.

24. A fuel-fired water heater comprising:

a tank for holding water to be heated, said tank being disposed within a jacket structure defining a vertically extending insulation cavity circumscribing said tank;

a combustion chamber disposed beneath said tank in thermal communication therewith;

a burner structure disposed within said combustion chamber and operative to create hot combustion products therein;

a fuel valve coupled to said burner structure and operative to supply fuel thereto;

a flue communicating with said combustion chamber and extending upwardly through said tank;

a draft structure coupled to said flue and operative to create a draft that draws the created hot combustion products upwardly through said flue;

a sensor positioned and operative to be engaged by and detect flammable vapors exteriorly adjacent said water heater and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor, and then to said draft structure through said flow path, without causing the flammable vapors to interiorly traverse said combustion chamber in an exposed relationship therewith, said conduit structure being a portion of said jacket structure.

25. A fuel-fired water heater comprising:

a tank for holding water to be heated, said tank being disposed within a jacket structure defining a vertically extending insulation cavity circumscribing said tank;

a combustion chamber disposed beneath said tank in thermal communication therewith;

a burner structure disposed within said combustion chamber and operative to create hot combustion products therein;

a fuel valve coupled to said burner structure and operative to supply fuel thereto;

a flue communicating with said combustion chamber and extending upwardly through said tank;

a draft structure coupled to said flue and operative to create a draft that draws the created hot combustion products upwardly through said flue;

a sensor positioned and operative to be engaged by and detect flammable vapors exteriorly adjacent said water heater and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor, and then to said draft structure through said flow path, without causing the flammable vapors to interiorly traverse said combustion chamber in an exposed relationship therewith, said conduit structure extending through said combustion chamber and said flue.

26. A fuel-fired water heater comprising:

a tank for holding water to be heated, said tank being disposed within a jacket structure defining a vertically extending insulation cavity circumscribing said tank;

a combustion chamber disposed beneath said tank in thermal communication therewith;

a burner structure disposed within said combustion chamber and operative to create hot combustion products therein;

a fuel valve coupled to said burner structure and operative to supply fuel thereto;

a flue communicating with said combustion chamber and extending upwardly through said tank;

a draft structure coupled to said flue and operative to create a draft that draws the created hot combustion products upwardly through said flue;

a sensor positioned and operative to be engaged by and detect flammable vapors exteriorly adjacent said water heater and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor, and then to said draft structure through said flow path, without causing the flammable vapors to interiorly traverse said combustion chamber in an exposed relationship therewith, said conduit structure extending through said tank.

27. A fuel-fired water heater comprising:

a tank for holding water to be heated, said tank being disposed within a jacket structure defining a vertically extending insulation cavity circumscribing said tank;

a combustion chamber disposed beneath said tank in thermal communication therewith;

a burner structure disposed within said combustion chamber and operative to create hot combustion products therein;

a fuel valve coupled to said burner structure and operative to supply fuel thereto;

a flue communicating with said combustion chamber and extending upwardly through said tank;

a draft structure coupled to said flue and operative to create a draft that draws the created hot combustion products upwardly through said flue;

a sensor positioned and operative to be engaged by and detect flammable vapors exteriorly adjacent said water heater and responsively preclude delivery of fuel from said valve to said burner structure; and a conduit structure communicated with said draft structure, extending to adjacent said sensor, and defining a flow path isolated from direct communication with said combustion chamber;

said conduit structure being operative to utilize said draft to forcibly draw adjacent flammable vapors across said sensor, and then to said draft structure through said flow path, without causing the flammable vapors to interiorly traverse said combustion chamber in an exposed relationship therewith, said conduit structure extending through said insulation cavity.

* * * * *